US010960439B1

(12) United States Patent
Cardosa, II

(10) Patent No.: US 10,960,439 B1
(45) Date of Patent: Mar. 30, 2021

(54) DETACHABLY ATTACHABLE IMPLEMENT SCRAPER

(71) Applicant: John Cardosa, II, Phoenix, AZ (US)

(72) Inventor: John Cardosa, II, Phoenix, AZ (US)

( * ) Notice: Subject to any disclaimer, the term of this patent is extended or adjusted under 35 U.S.C. 154(b) by 0 days.

(21) Appl. No.: 16/810,888

(22) Filed: Mar. 6, 2020

(51) Int. Cl.
*B44D 3/16* (2006.01)
*B08B 1/00* (2006.01)

(52) U.S. Cl.
CPC ..... *B08B 1/005* (2013.01)

(58) Field of Classification Search
CPC ..... B44D 3/128; B44D 3/16; B44D 3/162; B44D 3/164; B08B 1/005
USPC ..... 220/700, 699, 701, 697
See application file for complete search history.

(56) References Cited

U.S. PATENT DOCUMENTS 2,167,217 A 7/1939 Milligan
2,536,215 A 1/1951 Povondra
2,943,761 A 7/1960 Monier
3,260,401 A 7/1966 Cortina
3,899,107 A * 8/1975 Gaal ..... B44D 3/123 222/570
3,901,256 A * 8/1975 Habostad ..... B44D 3/006 134/138
4,101,046 A 7/1978 Puntillo
4,867,332 A * 9/1989 Mains ..... B25H 3/04 220/735
5,033,704 A 7/1991 Kerr
5,195,662 A * 3/1993 Neff ..... B44D 3/128 220/700
5,839,152 A 11/1998 Kruskamp
6,705,480 B1 * 3/2004 Saddler ..... B44D 3/12 220/4.03
8,607,397 B1 12/2013 Caver

* cited by examiner

*Primary Examiner* — Stephen J Castellano
(74) *Attorney, Agent, or Firm* — Invention To Patent Services; Alex Hobson

(57) ABSTRACT

An implement scraper provides a scraper bar for scraping debris into a bucket, such as a five-gallon bucket, and is detachably attachable to the bucket by a bucket coupler. The bucket coupler is configured with a latch that rotates to secure the implement scraper to the rim of the bucket. The latch may be pivotably coupled between a latch pivot aperture. A rim extension is configured to extend along a rim of the bucket and the scraper bar is coupled to the rim extension and may extend across an extension angle of the bucket. A debris aperture is formed between the scraper bar and the rim extension to allow debris to fall therethrough into the bucket. A magnetic coupler is configured to retain a metallic implement to the implement scraper by one or more magnets.

22 Claims, 12 Drawing Sheets

DETACHABLY ATTACHABLE IMPLEMENT SCRAPER

BACKGROUND OF THE INVENTION

Field of the Invention

The invention relates to an implement scraper having a bucket coupler for retaining a scraper bar to a bucket, such as a conventional five-gallon bucket, with the scraper bar extending across a portion of the top of the bucket and forming a debris aperture for debris to fall from the scraper bar into the bottom of the bucket.

Background

A bucket, such as a five-gallon bucket, is used in a wide array of functions including, painting, compound mixing, tile setting, grout application, flooring leveler application, drywall joint compound application, cleaning and the like. In many of these situations an implement is also used during the function or job. There are any number of implements that are used in conjunction with a bucket including mixing blades, drywall tools including a spackling blade, grouting tools such as a grout float, tile adhesive tools including a trowel and sponge and the like. Some of these implements may be used for spreading or applying contents within the bucket. Oftentimes, a person will insert the implement into the bucket to place material on the implement and then scrape off excess material on the side of the bucket. The material will oftentimes stick to the side of the bucket and dry. This dry material can then fall into the wet material in the bottom of the bucket and contaminate it. For example, tile adhesive may dry on the side of the bucket and fall back into the wet tile adhesive as chunks. When the wet material is retrieved from the bottom of the bucket and spread on a wall, the dry chunks both compromise the adhesion of the tile pieces and create inconsistencies in leveling from piece to piece.

SUMMARY OF THE INVENTION

The invention is directed to an implement scraper configured to detachably attach to a top rim of a bucket to provide a scraper bar that extends across the top opening of the bucket for scraping debris from a tool, such as a trowel. An exemplary implement scraper has a rim extension having a rim slot that extends over the top rim of the bucket and wherein the scraper bar is coupled proximal to the extended ends of the rim extension. A debris aperture is configured between the scraper bar and the rim extension to allow debris to fall therethrough down into the bucket. An exemplary implement scraper is detachably attachable to a bucket by a latch having a latch lock that engages with the bucket when the latch is pivoted down into a secure or locked configuration.

An exemplary implement scraper is configured to detachably attach to a top rim of a bucket by a rotating latch. The latch may be pivotably coupled in a latch slot in the latch flanges that extends down from the rim extension on the outside of the bucket. A latch may be configured in the latch slot by a latch pivot. A pivot extension may extend between the latch flanges and the latch to pivotably engage the latch in the latch slot. In an exemplary embodiment, the latch has latch extensions, cylindrical extensions that extend into apertures in the latch flanges to pivotably connect the latch in the latch slot, thereby enabling the latch to rotate in the latch slot. Note that the pivot may be reversed, wherein the latch has pivot apertures for receiving latch extensions extending from the latch flanges. In addition, a separate component, such as a pin may extend through the latch and into apertures of the latch flanges to form the pivot. The latch may have a handle that enables a user to rotate the latch from an insertion position, whereby the rim extension of the implement scraper can be slid down over the top rim of the bucket, to a closed position, wherein the latch lock is rotated to engage with the bucket rim and particularly with the rim flange of the bucket, a downward extension from the top rim of the bucket. The latch lock is secured between the rim flange and the exterior surface of the bucket to retain the implement scraper to the bucket. In an insertion position, the latch is rotated away from the rim slot of the implement scraper to enable the implement scraper to be slid down over the top rim of the bucket.

The latch may be retained by moving past a latch detent in the interior flange. This latch detent enables the latch lock to deflect the bucket into the detent to rotate past this detent. The latch is then retained by the bucket flexing back into position after being deflected. A latch detent may be a curved recessed area extending along the interior flange. The latch lock may have a latch flange, a shape that is configured to contour with the top rim or the rim flange of the bucket. A latch lock may extend in a planar direction or may be curved to match the contour of the bucket as it rotates past the detent. A latch may have a latch end that is curved and may have a radius of curvature that is substantially the same as the outside surface of the bucket; wherein the radius of curvature of the latch lock end of the latch is within about 30%, or preferably within about 20% and even more preferably within about 10% of the radius of curvature of the top rim or bucket outside surface.

An exemplary rim extension has a rim slot configured between an interior flange and an exterior flange. This rim slot may be curved and may be configured to extend along a radius of curvature that is substantially the same as the top rim of the bucket or the outside surface of the bucket, wherein the radius of curvature of the rim slot is within about 30%, or preferably within about 20% and even more preferably within about 10% of the radius of curvature of the top rim or bucket outside surface. When the rim slot has a radius of curvature that is substantially the same or closely matches that of the top rim or top of the bucket, the implement scraper may be more securely retained to the bucket prior to and after latching with the latch. The rim extension may extend around a portion of the top rim of the bucket, as defined by an extension angle, which may be about 180 degrees or less, about 90 degrees or less, about 75 degrees or less, about 60 degrees or less and any range between and including the extension angles provided. It is to be understood that an extension angle of 180 degrees would extend the scraper bar across the center of the bucket and this may interfere with access to the bucket contents and therefore an extension angle of 120 degrees and preferably 100 degrees or less is preferred.

In an exemplary embodiment, the scraper bar is detachably attachable to the rim extension. The rim extension may have a slot for receiving the scraper bar therein and an interference fit with the scraper bar may secure the scraper bar in place. In an exemplary embodiment, the rim extension comprises a bar latch that is opened to receive the scraper bar and then closed to secure the scraper bar to the rim extension.

In an exemplary embodiment, the implement scraper comprises a magnetic coupler configured to retain a magnetic implement, an implement that can be retained by a magnet such as a steel implement, to the implement scraper. A magnetic coupler may comprise one or more magnets that are configured on the top of the rim extension.

An exemplary implement scraper may be configured to fit on a conventional five-gallon bucket, which has a rim and an outer rim diameter of about 11⅞ inches, or 30.16 cm. A bucket may be any size, however, and may have a top rim diameter of about 9 inches (22.86 cm) or more, about 12 inches (30.48 cm) or more, about 15 inches (38.10 cm) or more, about 20 inches (50.80 cm) or more and any range between and including the diameter values provided. The implement scraper may be sized to fit over a bucket of a particular rim diameter and the rim slot and latch lock or latch lock end may be curved or have a suitable radius of curvature for the rim diameter or outer surface diameter of the bucket.

A scraper bar may have a planar surface thereby producing a sharp edge at the edge of the planar surface for removing debris from an implement. The plane of the planar surface of scraper bar may extend horizontally, or vertically. In a vertical orientation, the scraper bar may be more resistant to downward force due to moment of inertia geometry factors.

The summary is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

FIG. 17 shows a front view of an exemplary latch having a radius of curvature that substantially matches the diameter of the bucket it is configured for attachment to.

FIG. 18 shows a perspective view of an exemplary latch having a radius of curvature that substantially matches the diameter of the bucket it is configured for attachment to.

Figure 1:
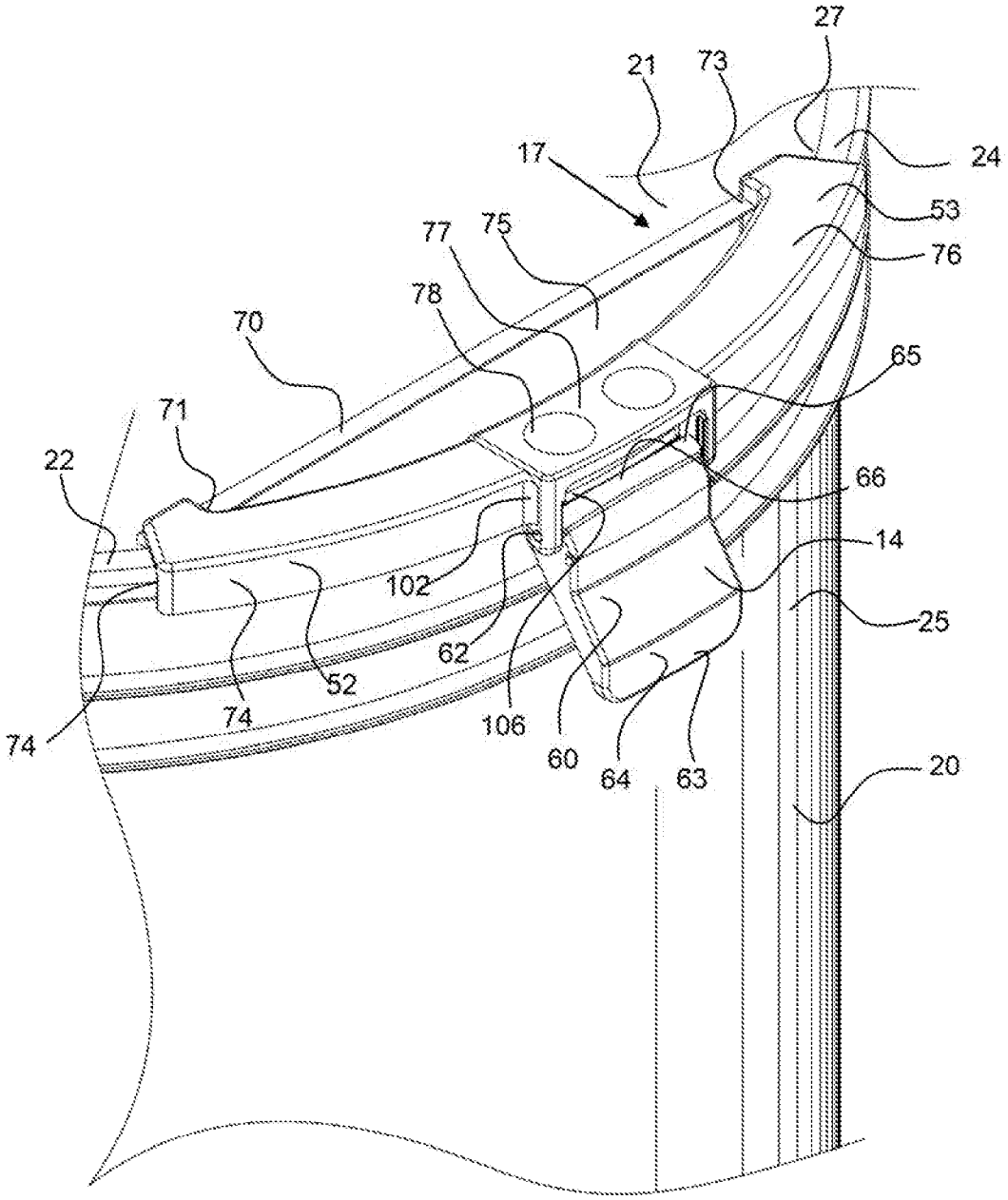
FIG. 1 shows a perspective view of an exemplary implement scraper having a bucket coupler for detachably attaching the implement scraper to the top rim of the bucket with the scraper bar extending across a portion of the top opening of the bucket and forming a debris aperture between the scraper blade and the rim extension to allow the debris to fall therethrough down into the bucket and a magnetic coupler for retaining a scraper implement, having metallic portions, such as the scraper blade to the implement scraper.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, uses of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

As shown in FIG. 1, an exemplary implement scraper 17 has a bucket coupler 14 for detachably attaching the implement scraper to the bucket 20. The bucket coupler has a latch 60 with a latch handle 64 that rotates about a latch pivot 62 to secure the latch lock 66 on the latch end 65 against the bucket, such as against the top rim 24 of the bucket. The implement scraper is configured with the scraper bar 70 extending across the top opening 21 of the bucket. The scraper extends from the right end 73 coupled with right rim extension to the left end 71 coupled with the left rim extension 74 and forms a debris aperture 75 between the scraper blade and the interior surface 27 of the wall 25 of the bucket 20 to allow the debris to fall therethrough, down into the bucket. The rim extension has an interior flange configured down along the interior of the bucket and an exterior flange 52 configured down over the exterior of the top rim of the bucket. This rim extension forms a rim slot that extends over the top rim of the bucket. The implement scraper is configured with magnetic coupler 77 having magnets 78 for retaining a scraper implement having metallic portions, such as a metallic trowel, to the implement scraper.

Figure 2:
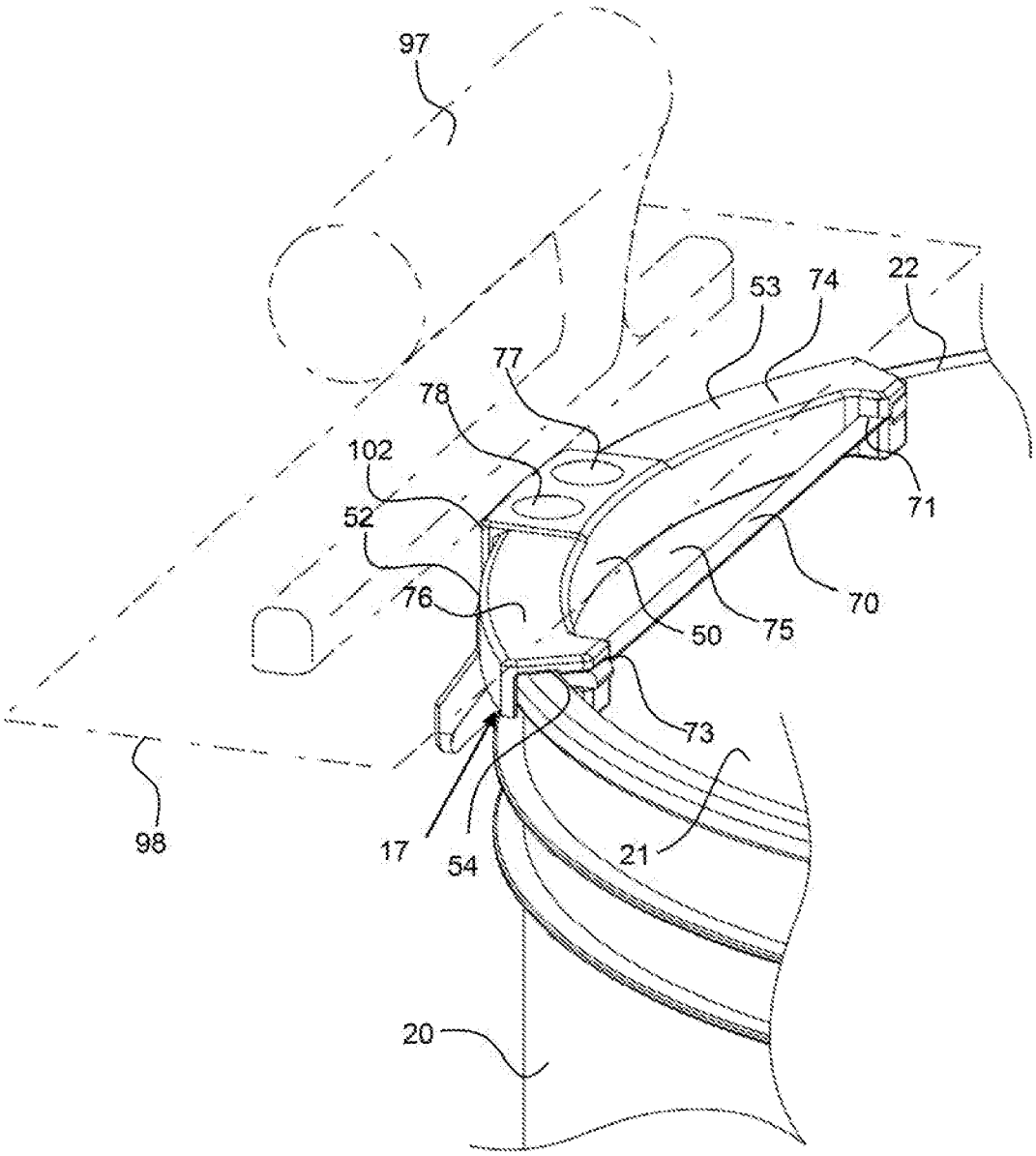
FIG. 2 shows a perspective view of the exemplary implement scraper having a scraper implement retained to the implement scraper by the magnetic coupler.
Figure 3:
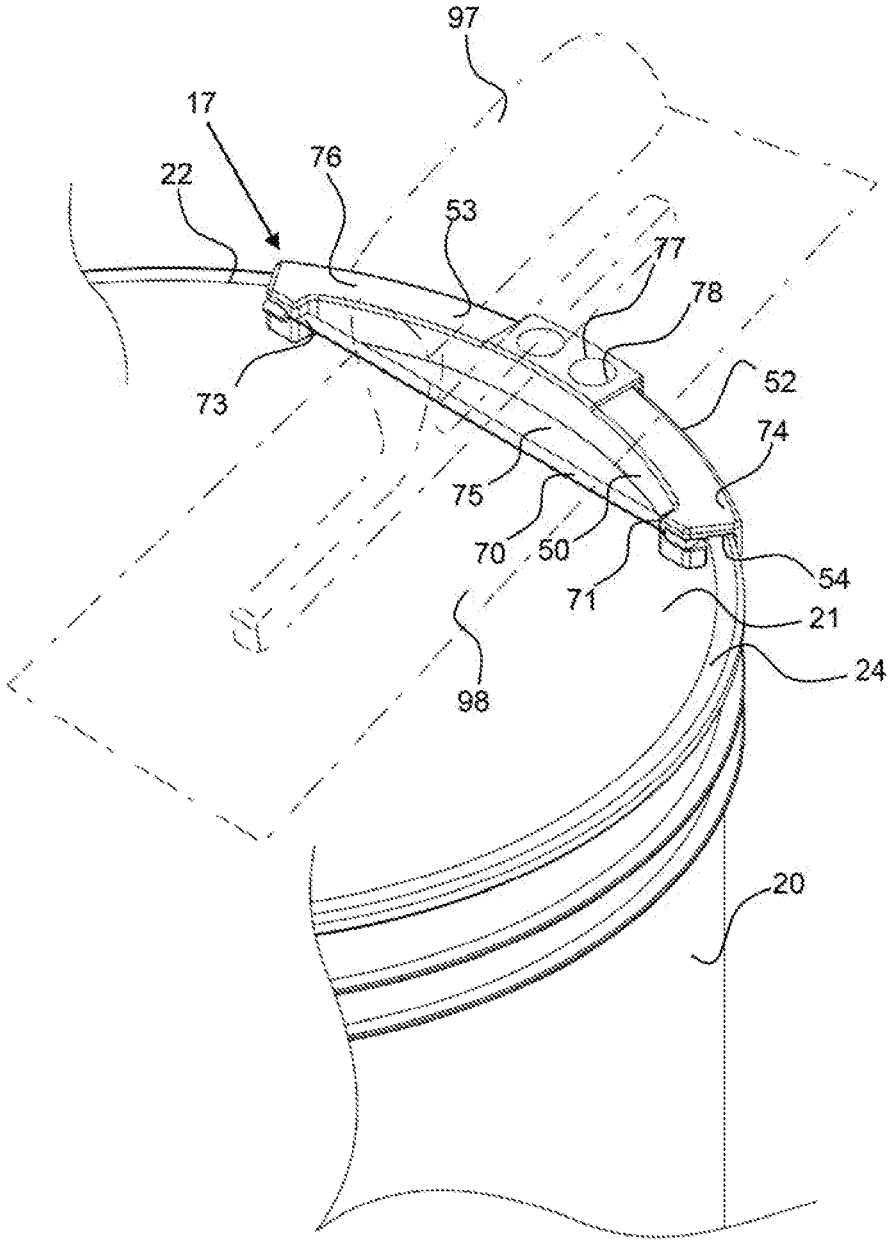
FIG. 3 shows a top perspective view of a scraper implement retained to the implement scraper by the magnetic coupler

Referring now to FIGS. 2 and 3, a scraper implement 97 is secured to the implement scraper 17 by the magnetic coupler 77. The scraper blade 98 of the scraper implement is metal, a magnetic implement, and is retained to the magnets 78 of the magnetic coupler. A worker may place a trowel on top of the magnetic coupler of the implement scraper while performing other tasks associated with the job. This protects the trowel from falling into the mixed compound in the bucket. Also shown in FIGS. 2 and 3 is the rim extension having a rim slot 54 formed by the interior flange 50, the rim extension top 53 and the exterior flange 54. The rim slot is configured with a radius of curvature to enable the implement scraper to be placed and retained over the top rim of the bucket.

Figure 4:
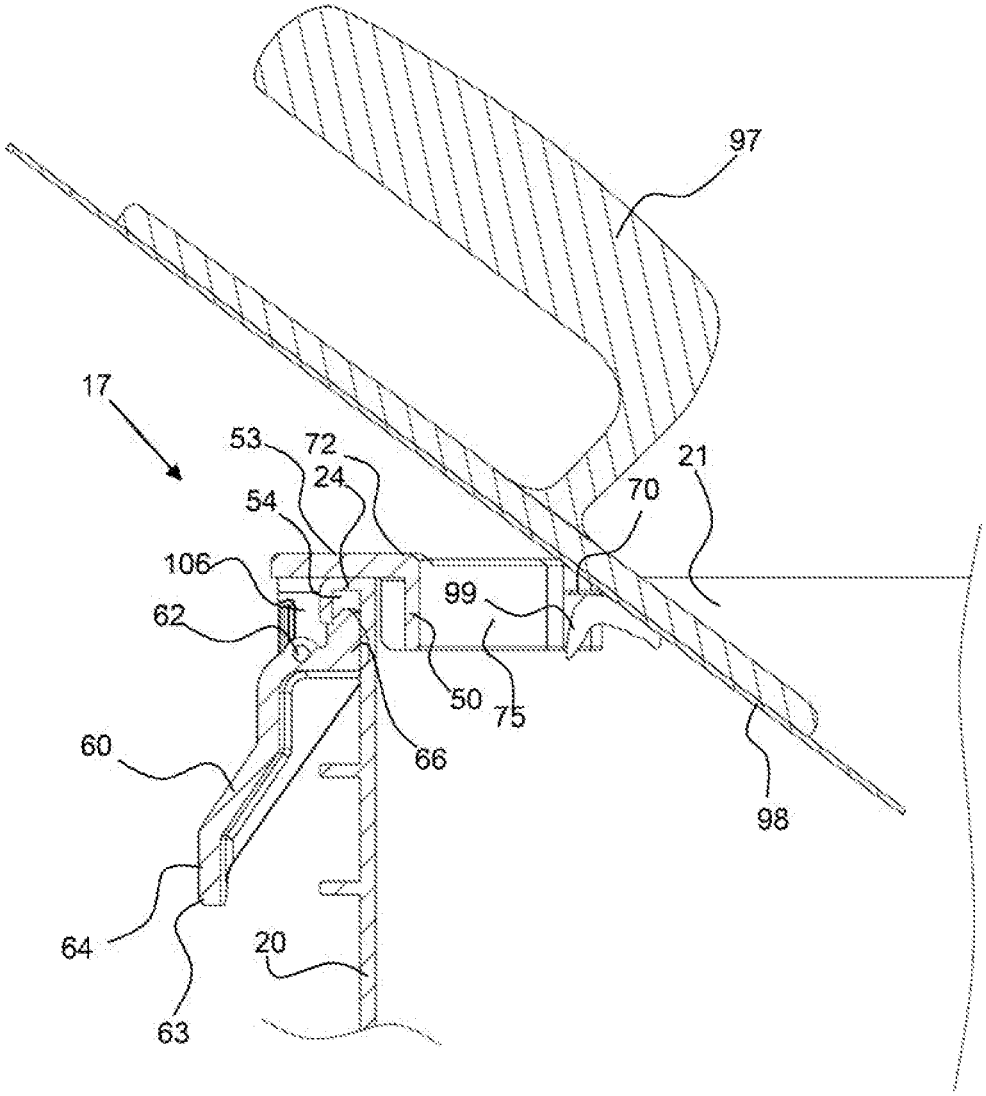
FIG. 4 shows a side cross sectional view of an exemplary implement scraper and a scraper implement scraping debris off of the scraper blade along the scraper bar and debris falling off of the scraper bar and into the bucket.
Figure 5:
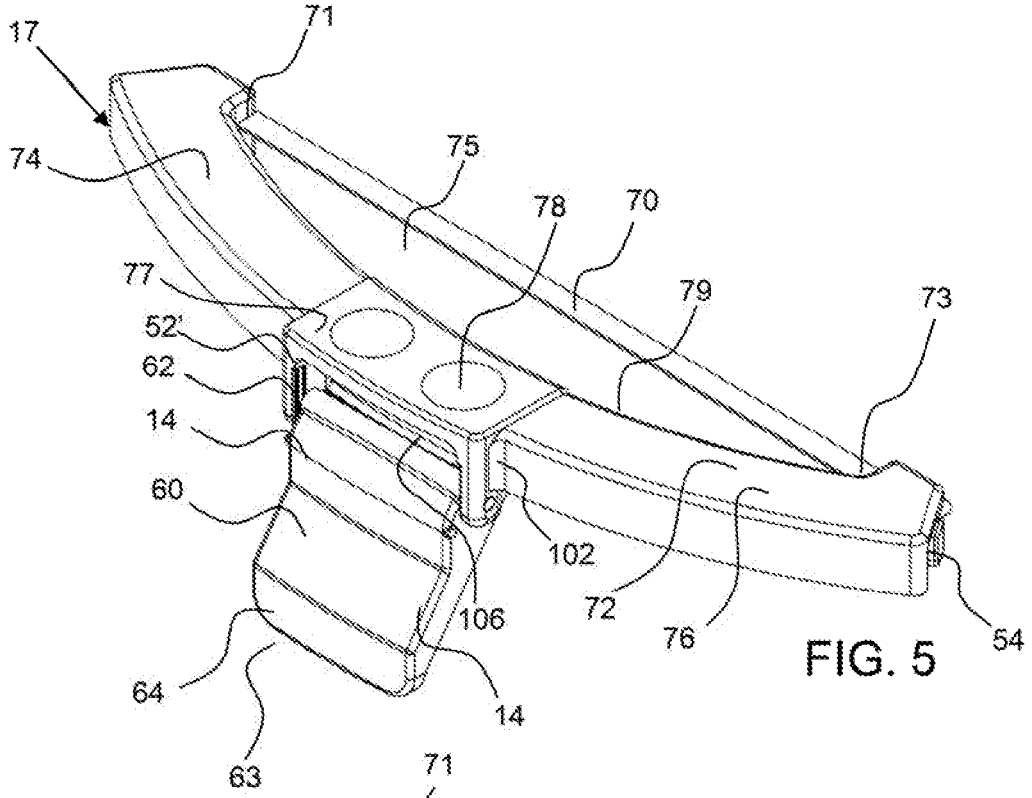
FIG. 5 shows a perspective view of an exemplary implement scraper.

As shown in FIG. 4, a scraper implement 97 is scraping debris 99 off of the scraper blade 98 along the scraper bar 70 and debris is falling off of the scraper bar and into the bucket 20. Debris may be scraped such that it falls between the scraper bar and the top opening 21 of the bucket and may fall through the debris aperture 75 formed between the scraper bar 70 and the rim extension 72 of the bucket coupler 17.

Figure 6:
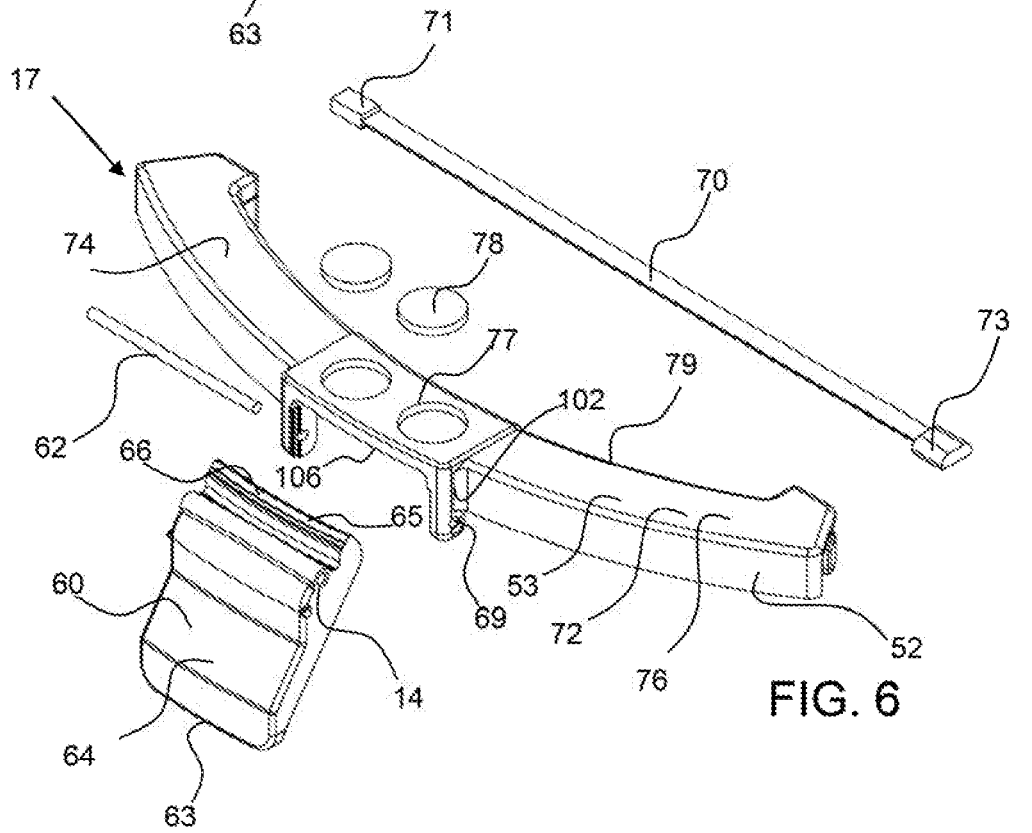
FIG. 6 shows an exploded view of an exemplary implement scraper.
Figure 7:
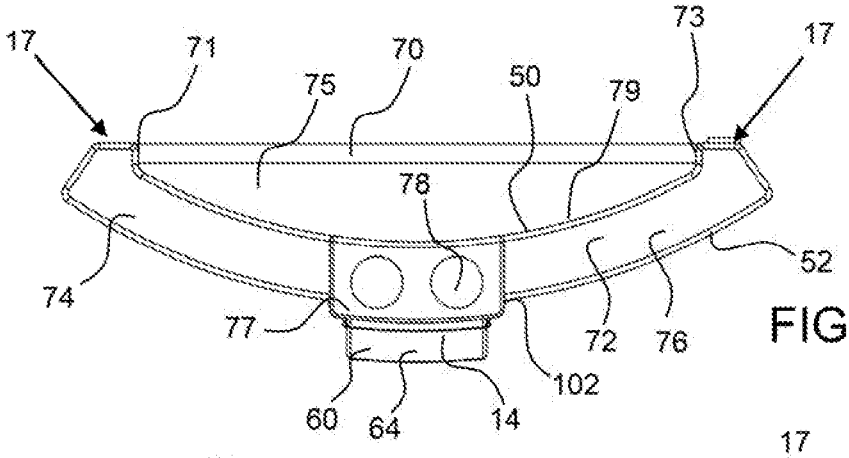
FIG. 7 shows a top view of an exemplary implement scraper.
Figure 8:
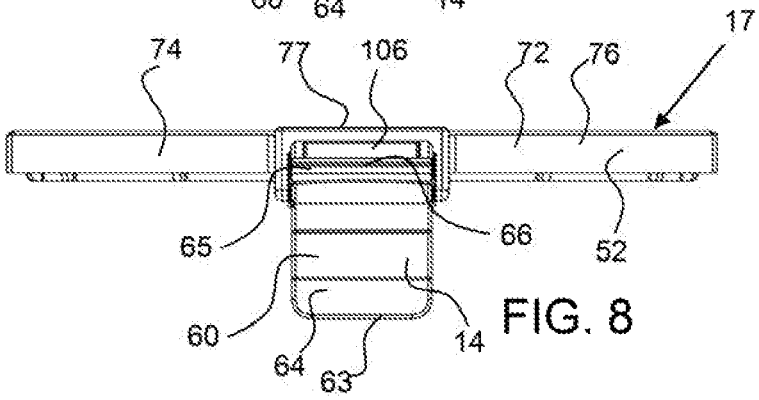
FIG. 8 shows a back view of an exemplary implement scraper.
Figure 9:
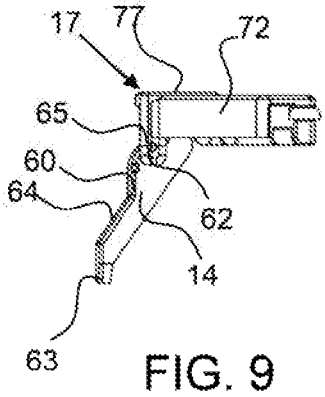
FIG. 9 shows a side view of an exemplary implement scraper.
Figure 10:
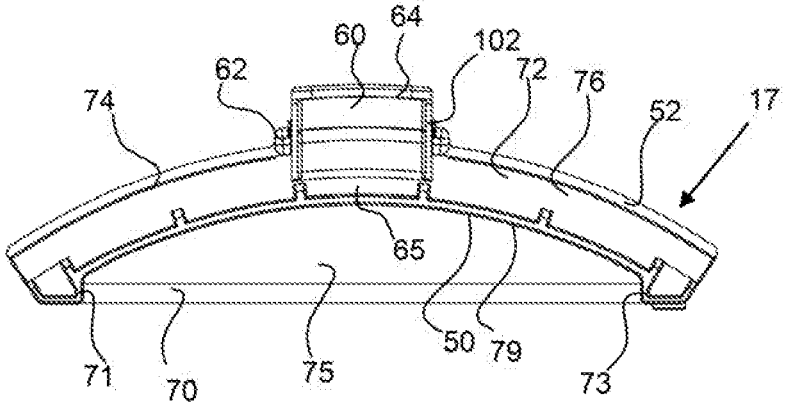
FIG. 10 shows a bottom view of an exemplary implement scraper.
Figure 11:
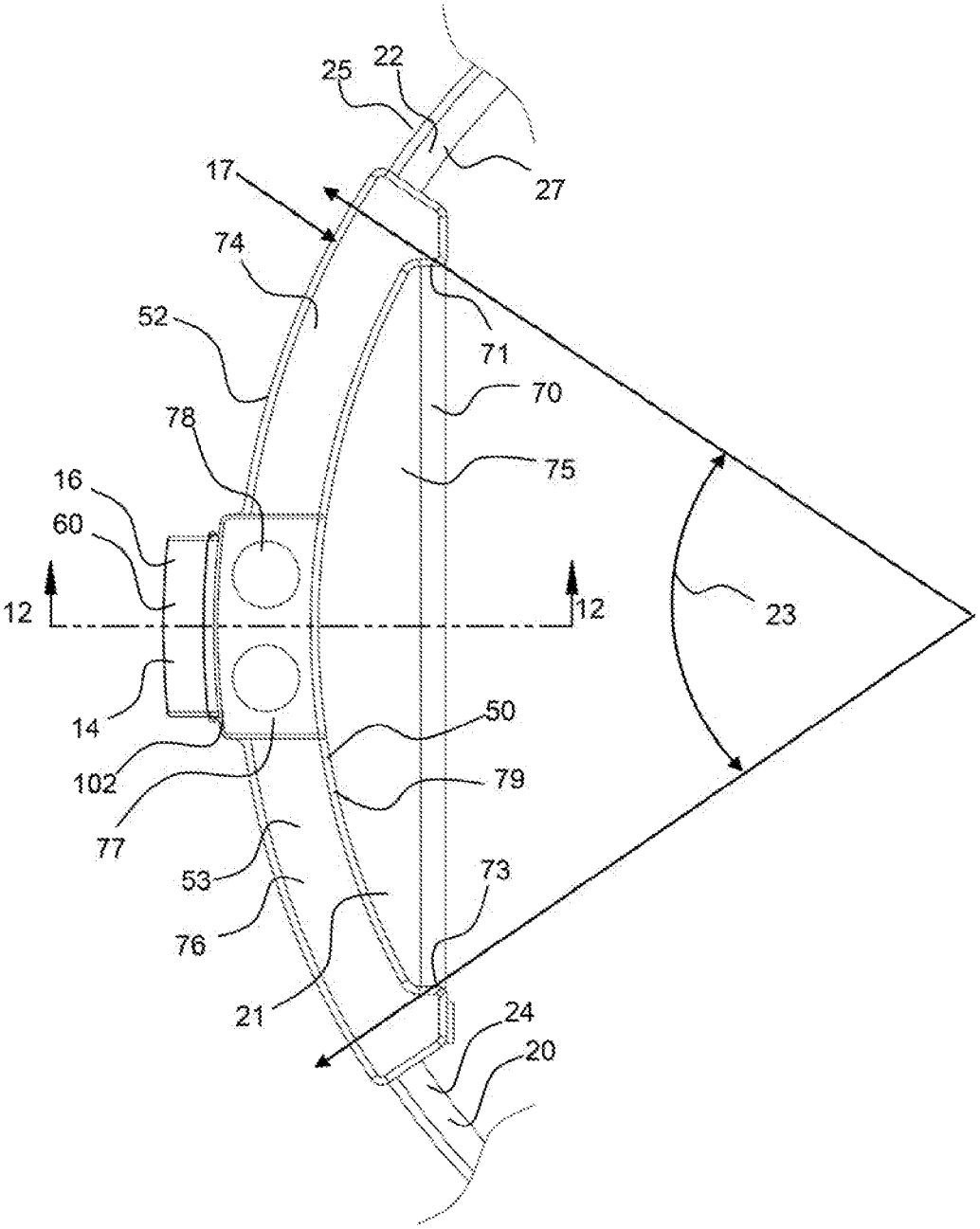
FIG. 11 shows a top view of an exemplary implement scraper and the debris aperture formed between the scraper bar and the inner surface of the wall of the bucket or the interior flange of the rim extension.

Referring to FIGS. 5 to 11, an exemplary implement scraper 17 has a rim extension 72 that is coupled to a top rim of a bucket. A left rim extension 74 extends circumferentially to the left from the bucket coupler 14 and magnetic coupler 77 and a right rim extension 76 extends to the right from the bucket coupler and magnetic coupler. A magnetic coupler 77 is configured on the top of the implement scraper, and has a pair of magnets 78 for retaining a scraper implement, or any other magnetic implement. The bucket coupler 14 has a latch 60 configured to detachably attach the implement scraper to the bucket. The latch handle 64 is configured to rotate about a latch pivot 62 to bring the latch lock end 65, and the latch lock 66 into engagement with the bucket, such as against the top rim of the bucket. The handle end 63 is rotated down to engage the latch lock with the bucket rim. The latch handle pivots within a latch slot 106 formed by the two opposing latch flanges extending down from the exterior flange. As shown in FIG. 6, the latch pivot 62, employs pivot extensions extending into latch pivot apertures 69 in the latch flanges 102. The scraper bar 70 is configured to extend across a top opening of a bucket and has a left end 71 and a right end 73 that are coupled proximal to the ends of the left rim extension and right rim extension, respectively. As shown in FIGS. 5 and 7 to 11, the scraper bar forms a debris aperture 75 between the scraper bar and the inside surface of the top extension 79 and the interior surface 27 of the wall 25 of the bucket. As shown in FIG. 11, the scraper blade extends an extension angle 23 around the outer circumference of the top rim 24 of the bucket. The extension angle shown is about 60 degrees.

Figure 12:
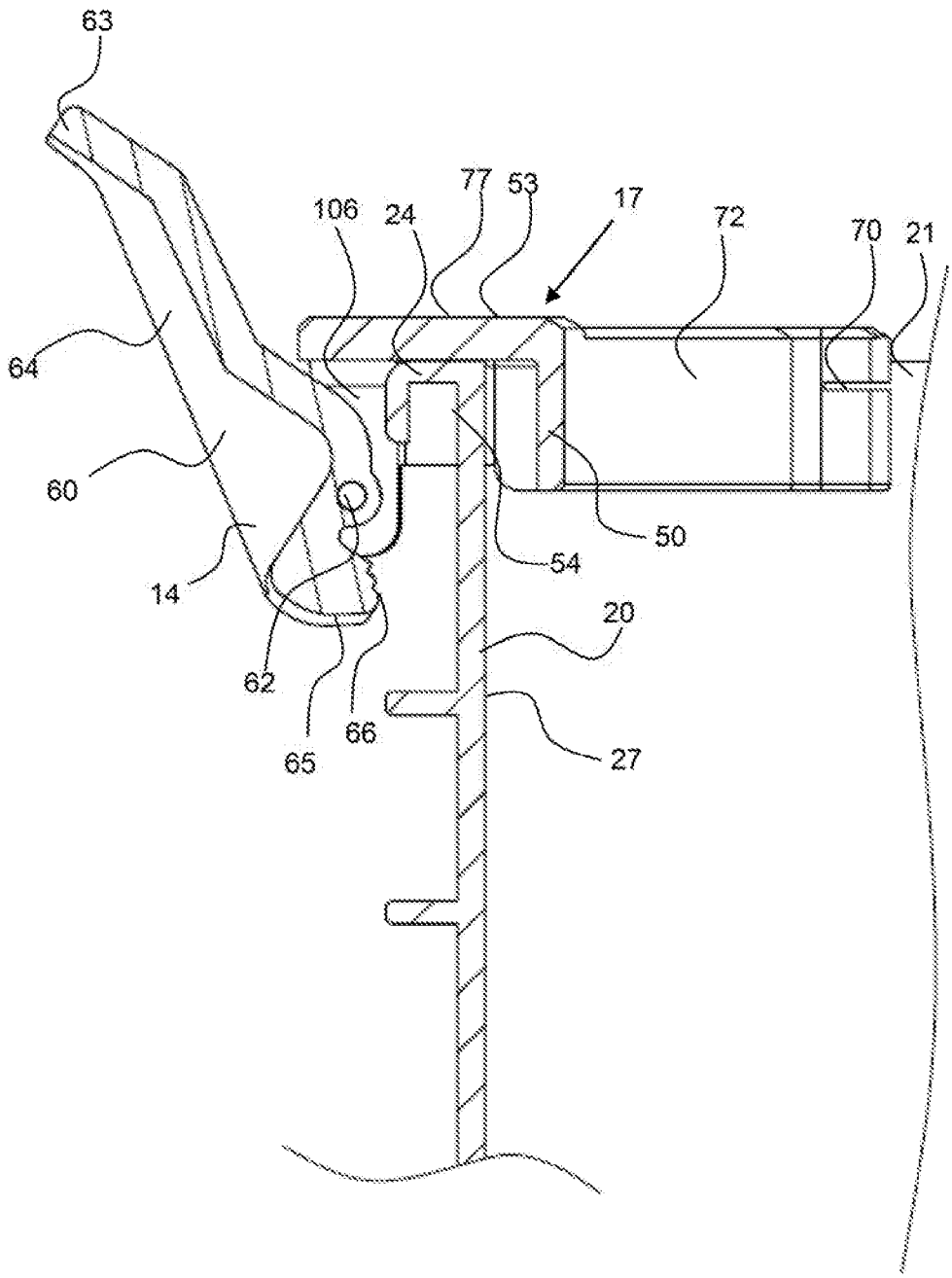
FIG. 12 shows a side cross sectional view of an exemplary implement scraper configured on the top rim of a bucket with the latch in an open configuration.
Figure 13:
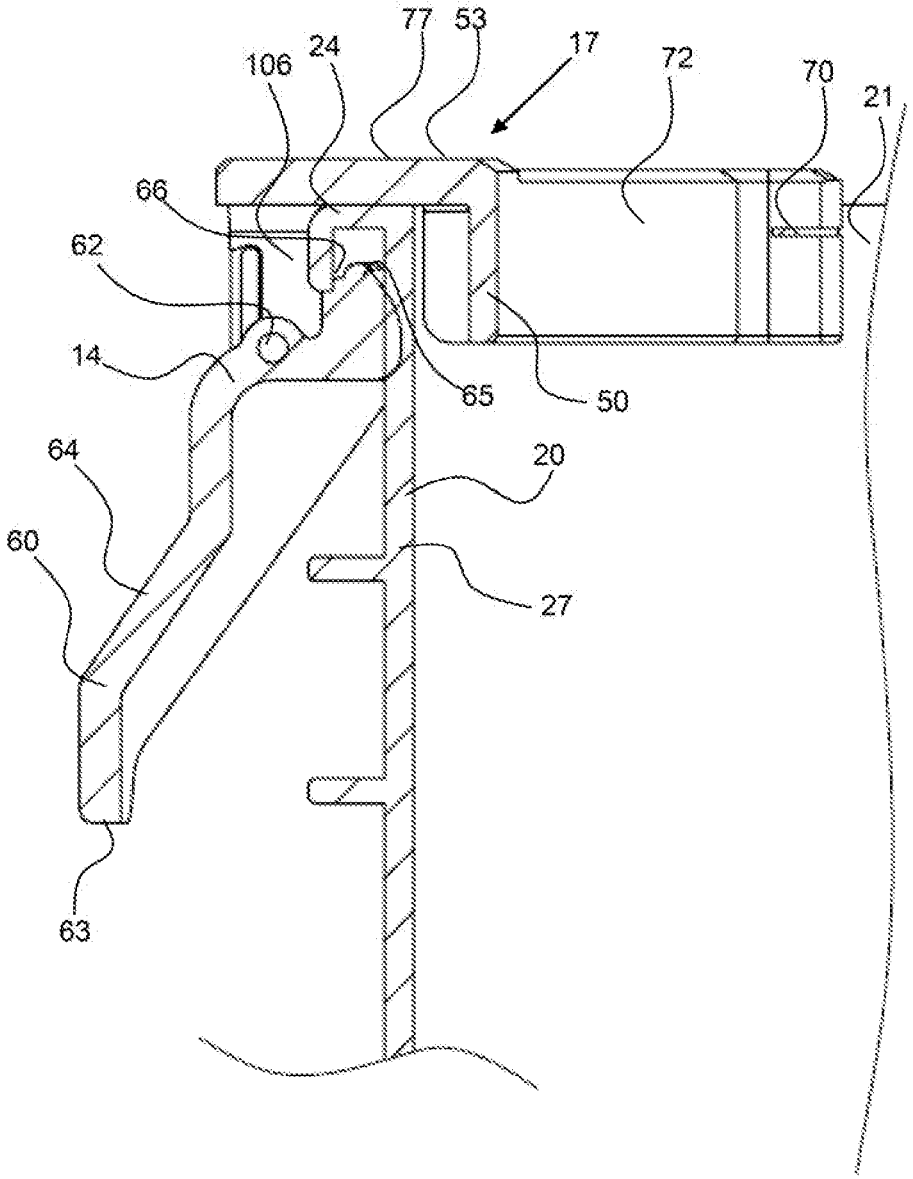
FIG. 13 shows a side cross sectional view of an exemplary implement scraper configured on the top rim of a bucket with the latch in a down and secured or latched configuration.

Referring now to FIGS. 12 and 13, an exemplary implement scraper 17 is configured on the top rim 24 of a bucket 20 with the rim slot 54 configured over the top rim of the bucket. In FIG. 12, the latch 60 is in an open configuration with the handle end 63 of the latch handle 64 rotated up and the latch lock end 65 and latch lock 66 rotated down away from the bucket. In FIG. 13, the latch handle 64 of the latch 60 is rotated about the latch pivot 62 to bring the latch lock end 65 and latch lock 66 into engagement with the top rim 24 of the bucket 20.

Figure 14:
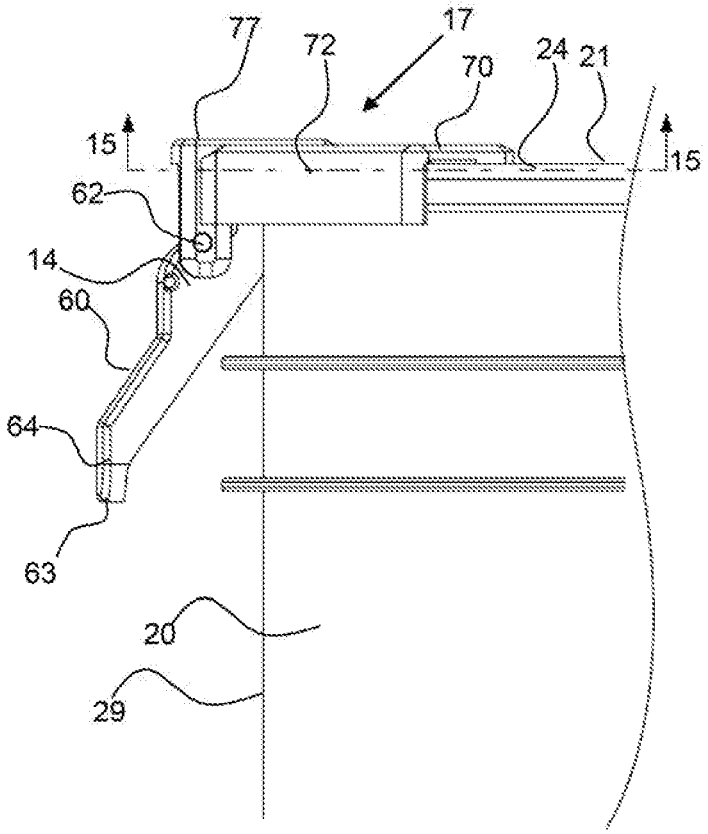
FIG. 14 shows a side view of an exemplary implement scraper configured on the top rim of a bucket with the latch in a down and secured or latched configuration.

As shown in FIG. 14, an exemplary implement scraper 17 is configured on the top rim 24 of a bucket 20 with the latch in a down and secured or latched configuration.

Figure 15:
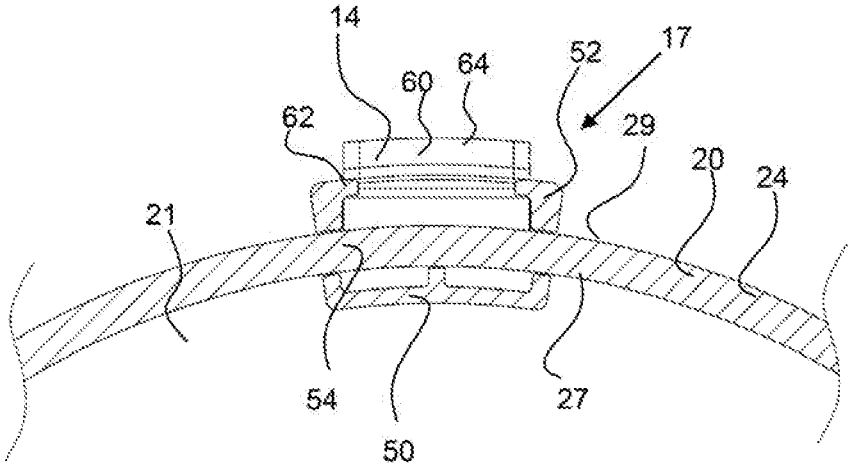
FIG. 15 shows a cross sectional view along line 15-15 of FIG. 14, of the implement scraper, not including the scraper bar, configured on the top rim of a bucket with the latch in a down and secured or latched configuration.

As shown in FIG. 15, the implement scraper 17 is configured on the top rim 24 of a bucket 20, with the latch 60 in a down and secured or latched configuration. The rim slot 54 is a slot in the implement scraper that extends over the top rim of the bucket from the interior surface 27 to the exterior surface 29.

Figure 16:
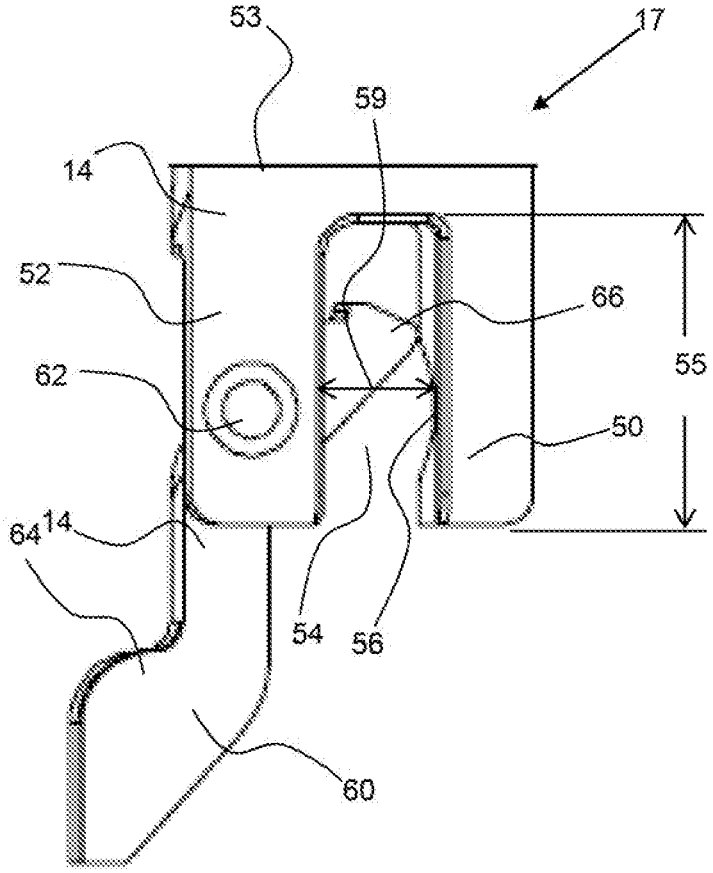
FIG. 16 shows a side view of an exemplary bucket coupler portion of an implement scraper.

Referring now to FIG. 16, the latch 60 is configured to rotate from an open position to a closed or locked position. The rim slot 54 is slightly wider than the top rim of the bucket and the width of the rim slot at the detent 56 is wider than the width of the rim slot above and below the detent. This detent allows the bucket wall to flex into the detent as the latch lock end of the latch handle 64 rotates up along the detent to provide a positive engagement past the detent to secure the bucket coupler 14 and implement scraper to the bucket. The detent slot width 59 is greater than the width of the rim slot 54 above and below the detent, as shown.

Figure 17:
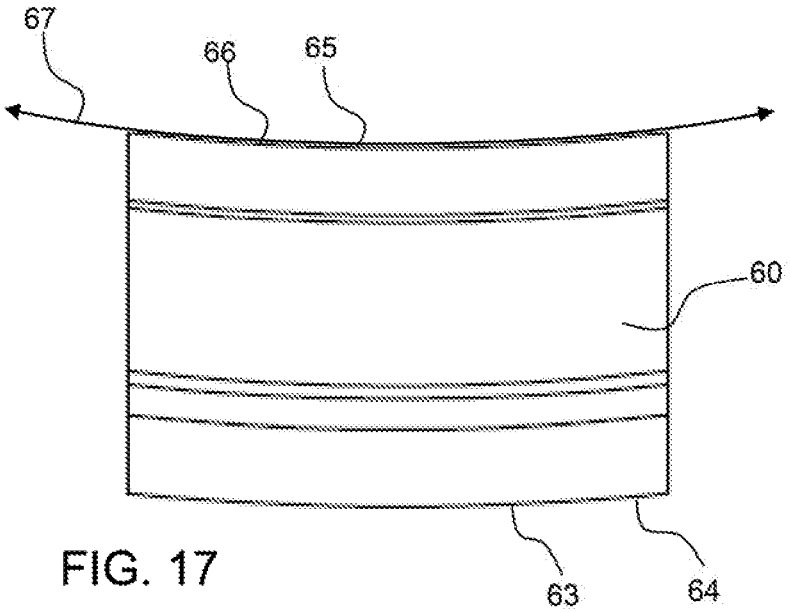
Figure 18:
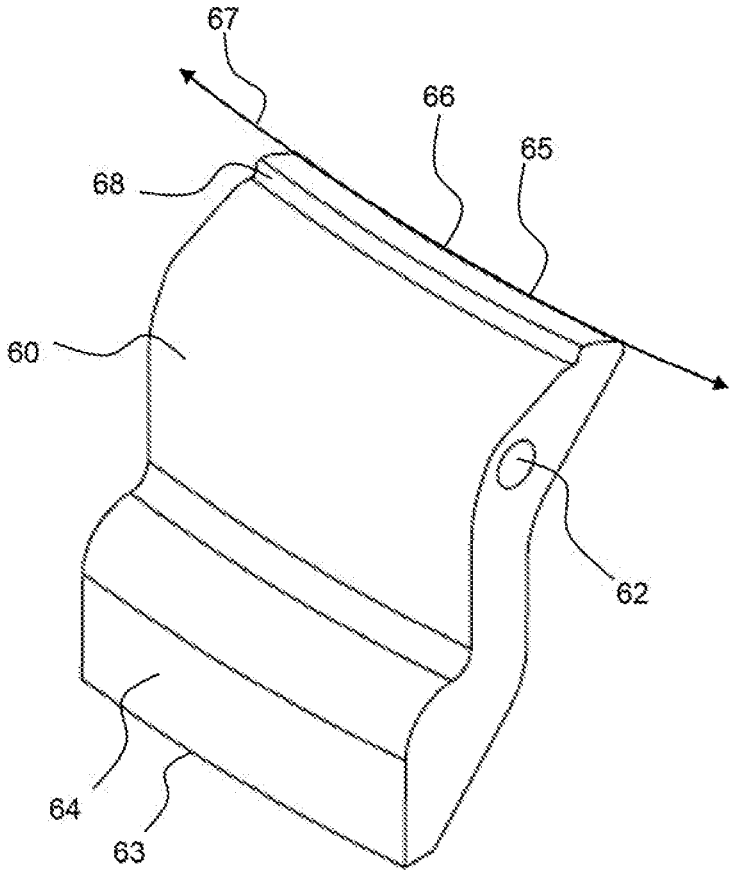

Referring now to FIGS. 17 and 18, an exemplary latch 60 has a latch lock end 65 that has a radius of curvature 67 that may correspond substantially, within about 30% and preferably within about 20%, and more preferably within about 10%, of a radius of curvature of the outside surface of a bucket or the bucket rim, to enable the latch lock to slide along the outside surface of the bucket and past the latch detent in the interior flange, as shown in FIG. 16. As shown in FIG. 18 the latch pivot includes a pivot aperture in the latch handle 64. Also, the latch lock end 65 comprises a latch lock 66 and latch flange 68, configured to abut with a downward extension of the top rim of the bucket.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. An implement scraper comprising:

a) a rim extension having a radius of curvature and configured to extend circumferentially along a top rim of a bucket, said rim extension comprising:

i) an interior flange configured for extending down over an interior surface of said bucket;

ii) an exterior flange configured to extend down over an exterior surface of said bucket;

iii) a rim extension top;

iv) a rim slot formed by said interior flange, exterior flange and rim extension top;

b) a scraper bar coupled to the rim extension and forming a debris aperture configured between the scraper bar and the rim extension;

wherein the scraper bar extends across a portion of a top opening of said bucket;

c) a bucket coupler configured to detachably attach to a top rim of said bucket, said bucket coupler comprising:

i) a pair of latch flanges extending down from the rim extension and forming a latch slot between said pair of latch flanges in the exterior flange;

ii) a latch pivotably coupled by a latch pivot within the latch slot, said latch extending from a handle end to a latch lock end; and wherein with the rim slot configured over said top rim of said bucket, the latch handle is configured on an exterior surface of said bucket and is configured to rotate the latch lock end to a closed position against said top rim of said bucket.

2. The implement scraper of claim 1, wherein the rim slot extends circumferentially in a radius of curvature configured to fit on a five-gallon bucket, wherein the radius of curvature is between 13 cm and 17 cm.

3. The implement scraper of claim 1, wherein the rim slot extends along a radius of curvature that is within 20% of a radius of curvature of the top rim of the bucket.

4. The implement scraper of claim 1, wherein a latch pivot aperture is configured in the latch flanges.

5. The implement scraper of claim 1, wherein a latch pivot aperture is configured in each of the latch flanges to receive a latch pin therein to pivotably couple the latch in the latch slot.

6. The implement scraper of claim 1, wherein the latch end of the latch has a radius of curvature that is within 30% of a radius of curvature of an outside surface of the bucket.

7. The implement scraper of claim 1, further comprising a magnetic coupler comprising a magnet to retain a magnetic implement to the implement scraper.

8. The implement scraper of claim 7, wherein the magnetic coupler is detachably attachable to the bucket coupler.

9. The implement scraper coupler of claim 1, wherein the scraper bar is detachably attachable to the implement scraper.

10. The implement scraper of claim 1, wherein the interior flange comprises a detent along an inside surface of the rim slot to allow the bucket to deflect as the latch lock is rotated past the detent.

11. The implement scraper of claim 10, wherein a detent slot width is greater than a rim slot width above and below the detent.

12. A method of coupling an implement scraper to a bucket comprising the steps of:

a) providing an implement scraper comprising:

i) a rim extension having a radius of curvature and configured to extend circumferentially along a top rim of said bucket, said rim extension comprising:

an interior flange configured for extending down over an interior surface of said bucket;

an exterior flange configured to extend down over the exterior surface of said bucket;

a rim extension top; and a rim slot formed by said interior flange, exterior flange and rim extension top;

ii) a scraper bar coupled to the rim extension and forming a debris aperture configured between the scraper bar and the rim extension;

wherein the scraper bar extends across a portion of a top opening of said bucket;

iii) a bucket coupler configured to detachably attach to a top rim of said bucket, said bucket coupler comprising:

a pair of latch flanges extending down from the rim extension and forming a latch slot between said pair of latch flanges in the exterior flange; and a latch pivotably coupled by a latch pivot within the latch slot, said latch extending from a handle end to a latch lock end;

b) placing the implement scraper over a top rim of a bucket with the rim slot configured over said top rim of said bucket; and c) rotating the latch handle to move the latch lock end along the rim slot against the bucket to a locked position;

wherein the latch handle is configured on an exterior surface of said bucket.

13. The method of claim 12, wherein the rim slot extends circumferentially in a radius of curvature configured to fit on a bucket, wherein the radius of curvature is between 13 cm and 17 cm.

14. The method of claim 13, wherein the rim slot extends along a radius of curvature that is within 20% of a radius of curvature of the top rim of the bucket.

15. The method of claim 12, wherein a latch pivot aperture is configured in the latch flanges.

16. The method of claim 12, wherein a latch pivot aperture is configured in each of the latch flanges to receive a latch pin therein to pivotably couple the latch in the latch slot.

17. The method of claim 12, wherein the latch end of the latch has a radius of curvature that is within 30% of a radius of curvature of an outside surface of the bucket.

18. The method of claim 12, further comprising a magnetic coupler comprising a magnet to retain a magnetic implement to the implement scraper.

19. The method of claim 18, wherein the magnetic coupler is detachably attachable to the bucket coupler.

20. The method of claim 12, wherein the scraper bar is detachably attachable to the implement scraper.

21. The method of claim 12, wherein the interior flange comprises a detent along an inside surface of the rim slot to allow the bucket to deflect as the latch lock is rotated past the detent.

22. The method of claim 21, wherein a detent slot width is greater than a rim slot width above and below the detent.

* * * * *